US007522144B2

(12) United States Patent
Kang et al.

(10) Patent No.: US 7,522,144 B2
(45) Date of Patent: Apr. 21, 2009

(54) DRIVER FOR DISPLAY DEVICE

(75) Inventors: Pil Sung Kang, Gumi-si (KR); Hyun Taek Nam, Dong-gu (KR)

(73) Assignee: LG Display Co, Ltd., Seoul (KR)

( * ) Notice: Subject to any disclaimer, the term of this patent is extended or adjusted under 35 U.S.C. 154(b) by 693 days.

(21) Appl. No.: 11/166,307

(22) Filed: Jun. 24, 2005

(65) Prior Publication Data

US 2006/0125757 A1 Jun. 15, 2006

(30) Foreign Application Priority Data

Dec. 13, 2004 (KR) ..... 10-2004-0105149

(51) Int. Cl.
*G09G 3/36* (2006.01)

(52) U.S. Cl. ..... 345/99; 345/100

(58) Field of Classification Search ..... 345/213, 345/98, 99, 100

See application file for complete search history.

(56) References Cited

U.S. PATENT DOCUMENTS

| | | | | |
|---|---|---|---|---|
| 7,030,852 | B2 * | 4/2006 | Ito et al. | 345/103 |
| 2001/0003447 | A1 * | 6/2001 | Murai et al. | 345/99 |
| 2002/0067331 | A1 * | 6/2002 | Takabayashi et al. | 345/99 |
| 2002/0084972 | A1 * | 7/2002 | Kim | 345/99 |
| 2002/0190767 | A1 * | 12/2002 | Gomm et al. | 327/161 |

* cited by examiner

*Primary Examiner*—Richard Hjerpe
*Assistant Examiner*—Randal Willis
(74) *Attorney, Agent, or Firm*—Brinks Hofer Gilson & Lione

(57) ABSTRACT

A driver for a display device includes: a timing controller for generating first and second signals; and a plurality of data drivers provided with a plurality of data drivers disposed on the left of the timing controller, a data driver disposed at the center thereof, and a plurality of data drivers disposed on the right thereof, wherein the plurality of data drivers disposed on the left are driven in response to the first signal, and the plurality of data drivers disposed on the right are driven in response to the second signal.

21 Claims, 6 Drawing Sheets

DRIVER FOR DISPLAY DEVICE

PRIORITY CLAIM

This application claims the benefit of the Korean Patent Application No. 105149/2004, filed on Dec. 13, 2004, which is incorporated by reference.

BACKGROUND OF THE INVENTION

1. Field of the Invention

The present invention relates to a display device, and more particularly, to a driver for a display device.

2. Description of the Related Art

There is a demand for a flat panel display device having excellent characteristics, such as slim profile, lightweight and low power consumption. Such a flat panel display device includes a liquid crystal display (LCD), an organic light-emitting diode (OLED), a plasma display panel (PDP), and so on. Among them, the LCD or OLED is driven in an active matrix method.

An LCD will now be described. All of the following descriptions can also be applied to the OLED.

FIG. 1 is a block diagram of a related art LCD.

Referring to FIG. 1, the related art LCD includes a timing controller 100, a gate driver 103, a data driver 105, and a liquid crystal panel 107. The timing controller 100 generates a timing control signal using external vertical/horizontal synchronization signals (Vsync, Hsync), and the gate driver 103 sequentially supplies a scan signal in response to the timing control signal. The data driver 105 converts digital image data into analog image data (gray scale) in response to the timing control signal. The liquid crystal panel 107 displays an image corresponding to the analog image data to a pixel connected to a line (that is, a gate line) selected by the scan signal. The timing controller 100 supplies the external digital image data to the data driver 105.

Texas Instrument's mini Low Voltage Differential Signal (LVDS) can be used to provide the digital image data from the timing controller 100 to the data driver 105.

The LVDS is a standard interface between the timing controller 100 and the data driver 105.

FIG. 2 is a block diagram of a mini LVDS interface between the timing controller and the data driver in the LCD of FIG. 1.

Referring to FIG. 2, first and second data drivers 105*a* and 105*b* are connected through an RLV bus line 111 to the left of a timing controller 100, and third and fourth data drivers 105*c* and 105*d* are connected through an LLV bus line 113 to the right of the timing controller 100. For convenience of explanation and without limitation, a total of four data drivers are shown in FIG. 2, two on the right of the timing controller 100 and two on the left of the timing controller 100. In a large-sized panel display device, a larger number of data drivers may be provided on the right and/or left of the timing controller. Each of the data drivers 105*a*, 105*b*, 105*c* and 105*d* shifts 6-bit digital image data 64 times to output analog image data over 384 channels.

The timing controller 100 supplies the digital image data to the RLV bus line 111 and the LLV bus line 113. Also, the timing controller 100 supplies data reset signal through the RLV bus line 111 to the first data driver 105*a* and through the LLV bus line 113 to the third data driver 105*c*. Each of the first and third data drivers 105*a* and 105*c* converts the digital image data into analog image data in response to the data reset signal. The first data driver 105*a* converts the digital image data into the analog image data in response to the data reset signal. When the first data driver 105*a* completes the operation of converting the digital image data into the analog image data, a predetermined carry signal is inputted to the second data driver 105*b*. The second data driver 105*b* converts the digital image data into analog image data in response to the carry signal. The third data driver 105*c* converts the digital image data into the analog image data in response to the data reset data. When the third data driver 105*c* completes the operation of converting the digital image data into the analog image data, a predetermined carry signal is inputted to the fourth data driver 105*d*. The fourth data driver 105*d* converts the digital image data into analog image data in response to the carry signal.

Each of the first to fourth data drivers 105*a*, 105*b*, 105*c* and 105*d* includes a shift register (not shown), a first latch (not shown), a second latch (not shown), and a second latch (not shown), a digital-to-analog converter (DAC) (not shown), and an output buffer (not shown). The shift register sequentially outputs a sampling signal in response to the data reset signal or the carry signal. The first latch sequentially outputs the digital image data according to the sampling signal outputted from the shift register. The second latch simultaneously outputs the digital image data stored in the first latch. The DAC converts the digital image data into analog image data on which gamma voltage is reflected. The output buffer temporarily stores the analog image data outputted from the DAC and then outputs it.

In such a mini LVDS interface, the same number of data drivers is disposed on the left and right of the timing controller. Accordingly, an even number of the data drivers can be provided.

Alternatively, an odd number of data drivers may be provided in a large-sized panel display device. An additional data driver may be provided to the left or right of the timing controller. When the data drivers to the left and right of the timing controller are driven simultaneously, the side that has the additional data driver will have a longer driving time. Since the driving time is different in the two sides of the timing controller an equal driving frequency cannot be used. Consequently, different driving frequencies must be used in the data drivers disposed on both sides of the timing controller.

When the number of the data drivers is different on both sides of the timing controller, the interface between the timing controller and the data driver in the LCD may be redesigned to provide for an even number of the data drivers. However, changing the design of the interface expends a large amount of time and the existing data drivers cannot be used, thereby resulting in a waste of resources.

SUMMARY OF THE INVENTION

A driver for a display device is capable of driving the odd number of data drivers in a mini LVDS interface by providing a data driver that is driven differently from data drivers provided on the left and right of a timing controller.

A driver for a display device, includes: a timing controller for generating a first signal and a second signal; and a plurality of data drivers disposed on the left of the timing controller, a data driver disposed at the center of the timing controller, and a plurality of data drivers disposed on the right of the timing controller, wherein the plurality of data drivers disposed on the left are driven in response to the first signal, and the plurality of data drivers disposed on the right are driven in response to the second signal.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION

A driver for a display device may stably drive an overall odd number of data drivers interfaced to a mini LVDS interface. An individual data driver included within the driver is divided into a first driving region and a second driving region such that the remaining undivided data drivers may be driven at a similar driving frequency.

Figure 1:
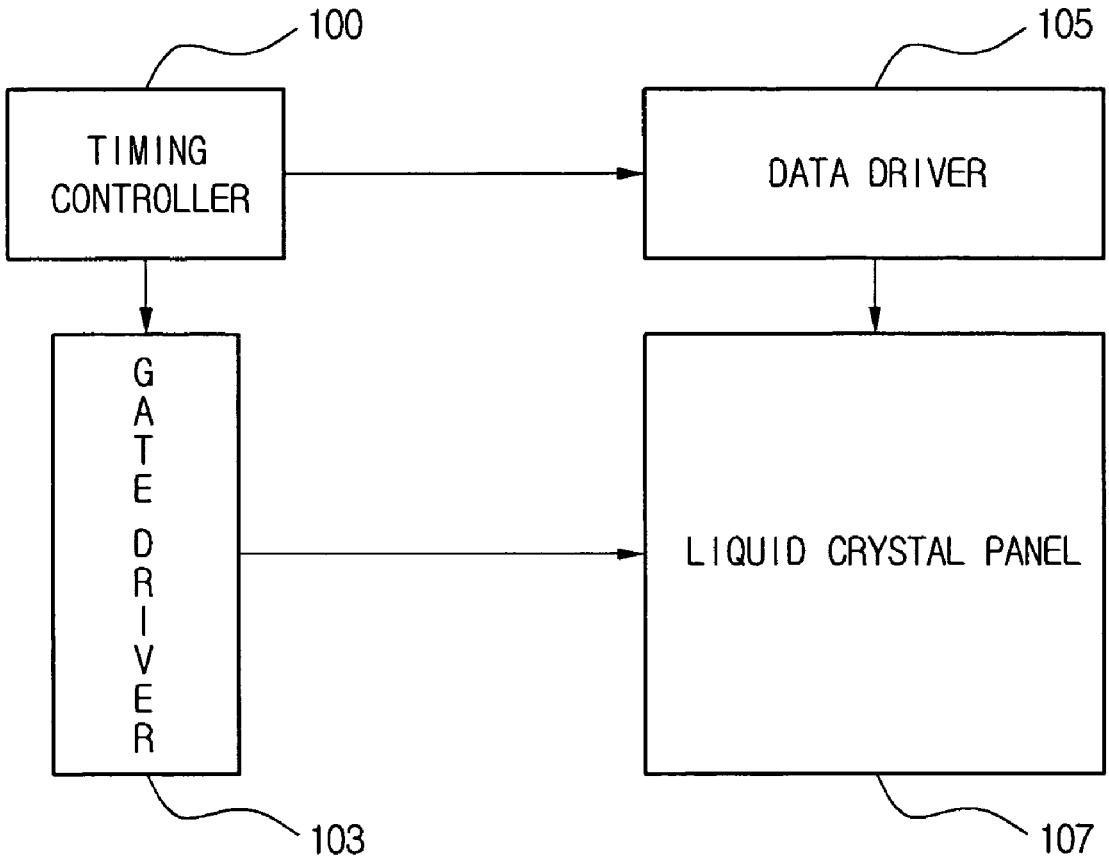
Fig.1 Related Art
FIG. 1 is a block diagram of a related art LCD.
Figure 2:
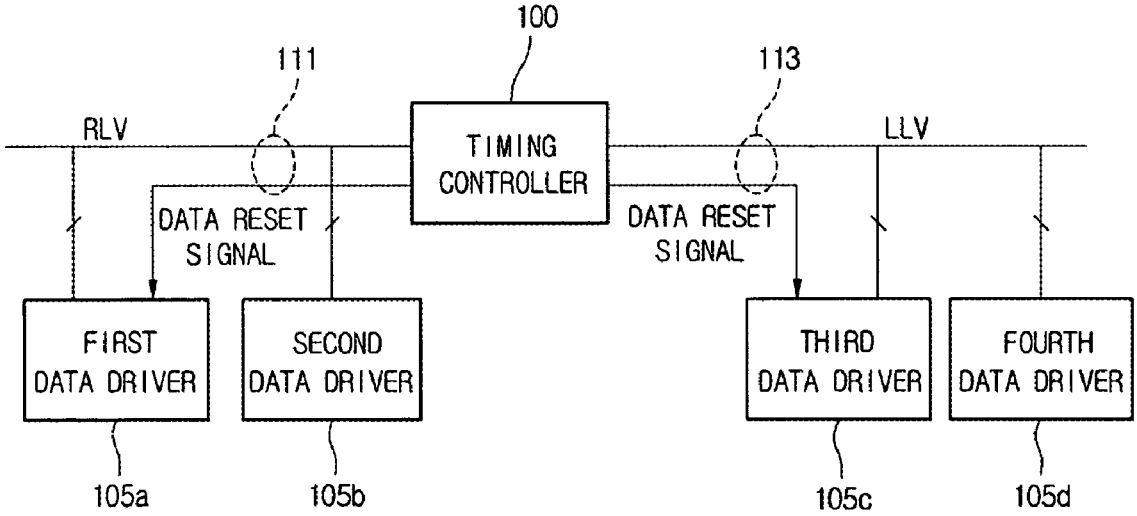
Fig.2 Related Art
FIG. 2 is a block diagram of a mini LVDS interface between the timing controller and the data driver in the LCD of FIG. 1.
Figure 3:
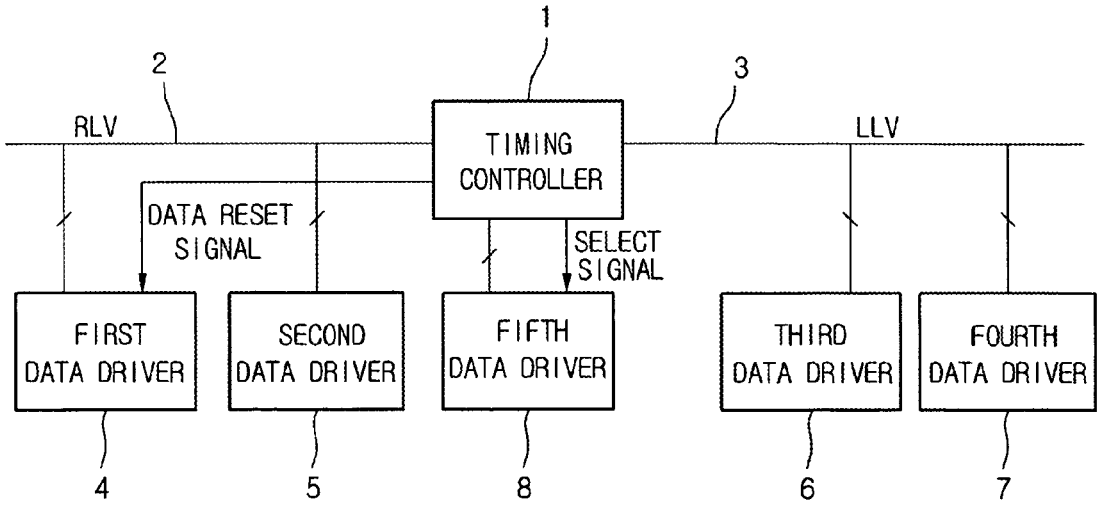
FIG. 3 is a block diagram of a mini LVDS interface between a timing controller and a data driver in an LCD according to an embodiment of the present invention.

FIG. 3 is a block diagram of a mini LVDS interface between a timing controller and a data driver in an LCD. First and second data drivers 4 and 5 are connected through an RLV bus line 2 to the left of a timing controller 1, and third and fourth data drivers 6 and 7 are connected through an LLV bus line 3 to the right of the timing controller 1. A fifth data driver 8 is separately provided in the center of the timing controller 1 Each of the first to fourth data drivers 4 to 7 shifts 6-bit digital images 64 times to output analog image data over 384 channels. The fifth data driver 8 includes a first shift register and a second shift register that operate separately and each register performs a shifting operation 32 times. A detailed description about these registers will be described later. For convenience of explanation and without limitation, a total of four data drivers are shown in FIG. 3, two on the right of the timing controller 1 and two on the left of the timing controller 1. In a large-sized panel display device, a larger number of data drivers may be provided on the right and/or left of the timing controller 1.

By providing an equal number of data drivers 4 to 7 on the left and right of the timing controller 1, the number of the data drivers is even. However, since the fifth data driver 8 is further provided in the center of the timing controller 1, the total number of data drivers is odd.

The timing controller 1 supplies the data reset signal and select signal simultaneously. The data reset signal is supplied to the first data driver 4 and the select signal is supplied to the fifth data driver 8.

Figure 4:
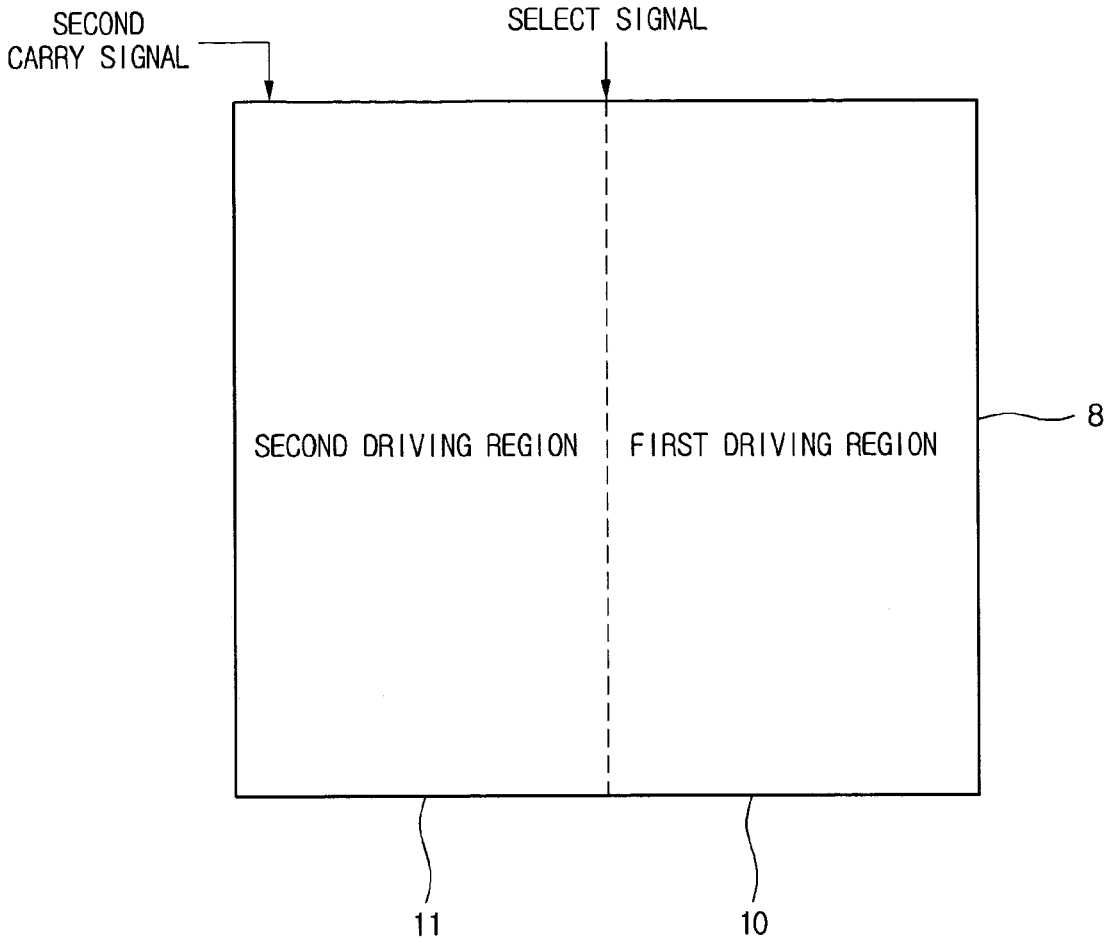
FIG. 4 is a view illustrating divided driving regions of the fifth data driver of FIG. 3.

As illustrated in FIG. 4, the fifth data driver 8 is divided into a first driving region 10 and a second driving region 11. The first driving region 10 is driven in response to the select signal, and the second driving region 11 is driven in response to a second carry signal generated from the second data driver 5 disposed at a previous stage of the fifth data driver 8. Since the fifth data driver 8 is also driven by 64-time shifting operations, the first and second driving regions 10 and 11 are driven by 32-time shifting operations, respectively.

Figure 5:
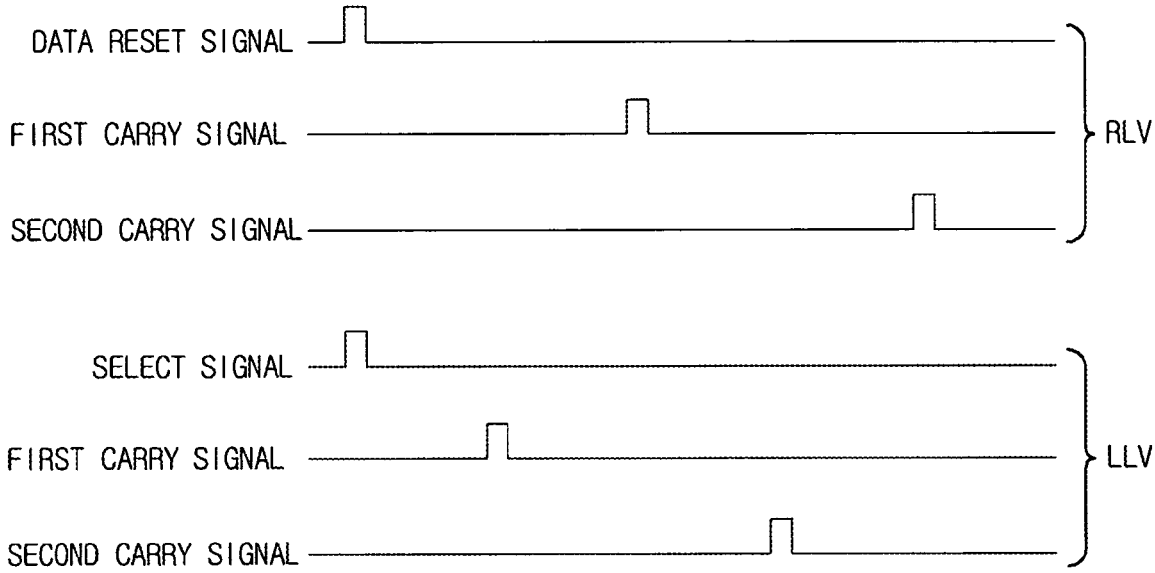
FIG. 5 is a waveform of signals used to drive the mini LVDS interface shown in FIG. 3.

Referring to FIG. 5, since the data reset signal and the select signal are simultaneously generated, the first data driver 4 supplied with the data reset signal and the first driving region 10 of the fifth data driver 8 supplied with the select signal are also driven simultaneously.

While the first data driver 4 performs the operation of converting the digital image data into the analog image data, the digital image data is converted into the analog image data in the first driving region 10 of the fifth data driver 8.

Upon completing the conversion of the digital image data into the analog image data according to the signals shifted in the 64-shifting operation of the first data driver 4, the first carry signal is generated and inputted to the second data driver 5. Then, the second data driver 5 converts the digital image data into analog image data according to the signal shifted 64 times in response to the first carry signal. When these operations are completed, the second carry signal is generated from the second data driver 5 and is inputted to the second driving region 11 of the fifth data driver 8. In the second driving region 11 of the fifth data driver 8, the digital image data is converted into analog image data according to the signals shifted 32 times in response to the second carry signal.

Meanwhile, in the first driving region 10 of the fifth data driver 8 supplied with the select signal generated simultaneously together with the data reset signal, digital image data is converted into analog image data according to the signal shifted 32 times in response to the select signal. When these operations are completed, the first carry signal is generated from the first driving region 10 of the fifth data driver 8 and is inputted into the third data driver 6. The third data driver 6 converts the digital image data into analog image data according to the signal shifted 64 times in response to the first carry signal. Then, the second carry signal is generated from the third data driver 6 and is inputted to the fourth data driver 7. The fourth data driver 7 converts the digital image data into analog image data according to the signal shifted 64 times in response to the second carry signal.

The fifth data driver 8 is divided into the first and second driving regions 10 and 11, and the first driving region 10 is driven in response to the select signal generated from the timing controller 1, and the second driving region 11 is driven in response to the second carry signal generated from the second data driver 5 disposed at the previous stage of the fifth data driver 8. Since the first and second driving regions of the fifth data driver 8 can be driven by an equal driving frequency, the waste of the driving frequency is reduced. Further, the waste of resources due to changing the design of the data driver can be reduced.

Since the structures of the first to fourth data drivers 4 to 7 are identical to those of the related art data drivers, a detailed description thereof will be omitted. However, since the structure of the fifth data driver 8 is different from those of the first to fourth data drivers 4 to 7, the following description will focus on the fifth data driver 8.

Figure 6:
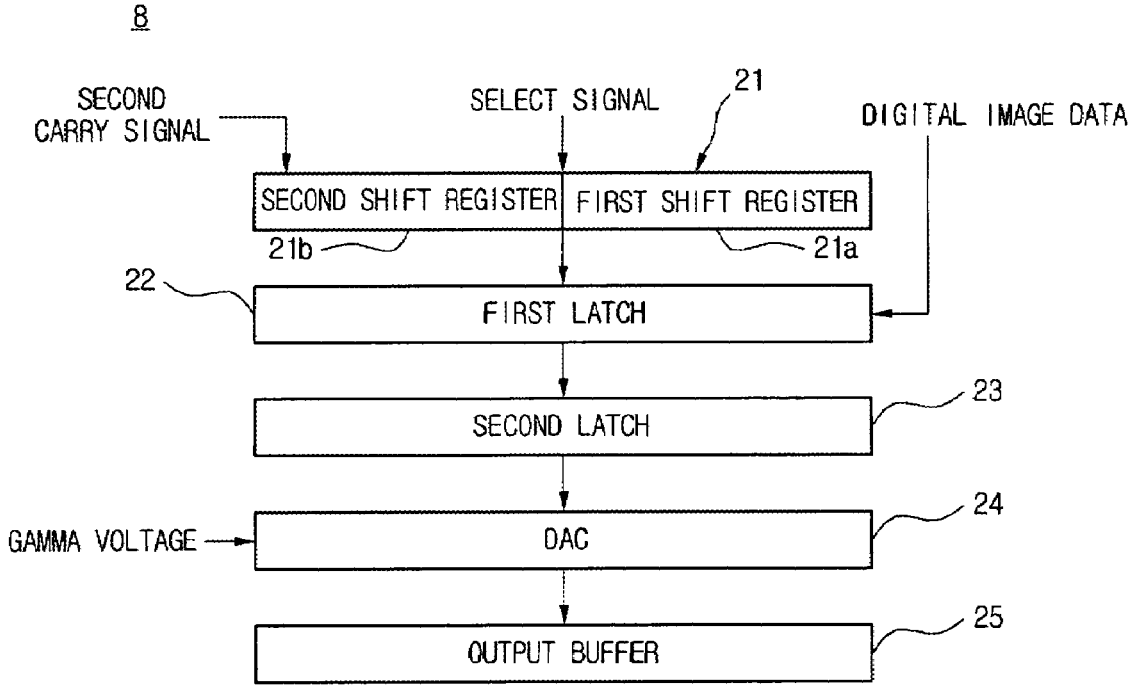
FIG. 6 is a block diagram of the fifth data driver shown in FIG. 3.

FIG. 6 is a block diagram of the fifth data driver shown in FIG. 3. The fifth data driver 8 includes a shift register 21 having a first shift register 21*a* and a second shift register 21*b*, a first latch 22, a second latch 23, a DAC 24, and an output buffer 25. The first shift register 21*a* performs a shifting operation in response to a select signal, and the second shift register 21*b* performs a shifting operation in response to a carry signal of a data driver 5 disposed at a previous stage of the fifth data driver 8. The first latch 22 sequentially latches digital image data according to an output signal of the shift register 21, and the second latch 23 simultaneously outputs the digital image data stored in the first latch 22. The DAC 24 converts the digital image data into analog image data on which gamma voltage is reflected. The output buffer 25 temporarily stores the analog image data outputted from the DAC 24 and then outputs it.

The select signal is generated at the same time when the data reset signal is generated from the timing controller 1. The select signal is supplied to a first flip-flop (not shown) of the first shift register 21*a*. The first flip-flop outputs a predetermined signal and simultaneously the select signal is inputted to a next flip-flop. In this manner, the first shift register 21*a* operates sequentially so that output signals (32 output signals) are inputted to the first latch 22. The first latch 22 latches digital image data corresponding to the 32 output signals. The second latch 23 simultaneously outputs the digital image data stored in the first latch 22. Then, the DAC 24 converts the digital image data into analog image data and then the analog image data are temporarily in the output buffer 25.

The second carry signal is generated from the second data driver 5. A first flip-flop (not shown) of the second shift register 21*b* is driven by the second carry signal. The first flip-flop outputs a predetermined signal and simultaneously the second carry signal is inputted to a next flip-flop (not shown). In this manner, the second shift register 21*b* operates so that the 32 output signals are inputted to the first latch 22. The first latch 22 sequentially latches the digital image data corresponding to the 32 output signals, and then the digital image data are again latched in the second latch 23. The DAC 24 converts the latched digital image data into analog image data and then the analog image data are temporarily stored in the output buffer 25.

After a predetermined time elapses from the operation of the first shift register 21*a*, responsive to the select signal, the second shift register 21*b* is operated by the second carry signal that is generated from the data driver 5.

As illustrated in FIG. 3, an equal number of the data drivers 4 to 7 are provided on the left and right of the timing controller 1. The separate data driver 8 divided into the first and second driving regions 10 and 11 that are separately driven according to the different signals (the select signal and the carry signal) is provided in the center of the timing controller 1. Accordingly, the total number of data drivers is odd. In such a configuration, the timing controller 1 generates the data reset signal and the select signal, which are synchronized with each other, and supplies the data reset signal to the first data driver 4 disposed on the left of the timing controller 1. The timing controller 1 also supplies the select signal to the first driving region 10 of the fifth data driver 8 provided in the center thereof. The time for driving the data drivers 4 and 5 disposed on the left side and the second driving region 11 of the fifth data driver 8 is equal to the time for driving the first driving region 10 of the fifth data driver 8 and the data drivers 6 and 7 disposed on the right side. Thus, the same driving frequency can be used in driving the left data drivers 4 and 5 and the right data drivers 6 and 7, thereby preventing the waste of frequency. It is unnecessary to change the design of the data drivers so as to drive an odd number of the data drivers, thereby preventing the waste of resources.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A driver for a display device, the driver comprising:

a timing controller for generating a first signal and a second signal; and a plurality of data drivers connected to receive signals from the timing controller for a left section, a data driver connected to receive signals from the timing controller for a center section of the display device, and a plurality of data drivers connected to receive signals from the timing controller for a right section, wherein the plurality of data drivers for the left section are driven in response to the first signal, and the plurality of data drivers for the right section are driven in response to the second signal, and wherein the data driver for the center section is divided into a first driving region that is driven in response to the second signal, and a second driving region that is driven in response to a carry signal generated from a previous-stage data driver.

2. The driver according to claim 1, wherein the first signal and the second signal are generated substantially simultaneously.

3. The driver according to claim 1, wherein the data drivers for the left section are arranged from a first data driver to an Nth data driver and wherein the previous-stage data driver is the Nth data driver of the data drivers for the left section.

4. The driver according to claim 1, wherein the first driving region includes a first shift register that performs a shifting operation in response to the second signal.

5. The driver according to claim 1, wherein the second driving region includes a second shift register that performs a shifting operation in response to the carry signal.

6. The driver according to claim 1, wherein the data drivers for the left section are arranged from a first data driver to an Nth data driver and wherein the first data driver of the data drivers for the left section is driven in response to the first signal.

7. The driver according to claim 1, wherein all of the data drivers except a first data driver for the left section are driven in response to a carry signal generated from a previous-stage data driver.

8. The driver according to claim 1, wherein the data drivers for the right section are driven in response to a carry signal generated from a previous-stage data driver.

9. A driver for a display device, the driver comprising:

a timing controller for generating a first signal and a second signal;

a first group of a plurality of data drivers for a first section of the display device, the data drivers connected to receive a signal from the timing controller, the first group of data drivers defining a group one data drivers arranged from a first data driver to an Nth data driver;

an individual data driver divided into a first driving region that is driven in response to the second signal, and a second driving region that is driven in response to a carry signal generated from a previous-stage data driver; and a second group of a plurality of data drivers for a second section of the display device, the data drivers connected to receive a signal from the timing controller, the second group of data drivers defining a group two data drivers arranged from a first data driver to an Nth data driver;

wherein the group one data drivers are driven in response to the first signal, and the group two data drivers are driven in response to the second signal.

10. The driver according to claim 9, wherein the first signal and the second signal are generated substantially simultaneously.

11. The driver according to claim 9, wherein the previous-stage driver is a Nth group one data driver.

12. The driver according to claim 9, wherein the first driving region includes a first shift register that performs a shifting operation in response to the second signal.

13. The driver of claim 9, wherein the second driving region includes a second shift register that performs a shifting operation in response to the carry signal.

14. The driver of claim 9, wherein a first group one data driver is driven in response to the first signal.

15. The driver according to claim 9, wherein all of the data drivers except the first group one data driver are driven in response to a carry signal generated from a previous-stage data driver.

16. The data driver according to claim 9, wherein the group two data drivers are driven in response to a carry signal generated from a previous-stage data driver.

17. A method of driving a display device comprising a timing controller for generating a first signal and a second signal, a first group of a plurality of data drivers for a first section of the display device, the data drivers connected to receive a signal from the timing controller, the first group of data drivers defining a group one data drivers arranged from a first data driver to an Nth data driver, an individual data driver divided into a first driving region that is driven in response to the second signal and a second driving region that is driven in response to a carry signal generated from a previous-stage data driver, and a second group of a plurality of data drivers for a second section of the display device, the data drivers connected to receive a signal from the timing controller, the second group of data drivers defining a group two data drivers arranged from a first data driver to an Nth data driver, the method comprising the steps of:

supplying the first signal to a first group one data driver, and supplying the second signal to the first driving region of the individual data driver.

18. The method of claim 17, wherein the first signal and the second signal are supplied substantially simultaneously.

19. The method of claim 18, further comprising the steps of:

generating a first group one carry signal that is inputted into a second group one data driver after the first group one data driver completes processing of the first signal; and generating a first group two carry signal that is inputted into a first group two data driver after the first driving region of the individual data driver completes processing of the second signal.

20. The method of claim 19, further comprising the steps of:

generating a second group one carry signal that is inputted into the second driving region of the individual data driver after the second group one data driver completes processing the first group one carry signal;

generating a second group two carry signal that is inputted into a second group two data driver after the first group two data driver completes processing the first group two carry signal.

21. A method of driving a display device comprising:

generating a first timing controller signal and a second timing controller signal;

grouping a plurality of data drivers for a first section of the display device into a first group, the data drivers connected to receive a timing controller signal, the first group of data drivers defining a group one data drivers arranged from a first data driver to an Nth data driver;

dividing an individual data driver into a first driving region that is driven in response to the second signal and a second driving region that is driven in response to a carry signal generated from a previous-stage data driver;

grouping a plurality of data drivers for a second section of the display device into a second group, the data drivers connected to receive a timing controller signal, the second group of data drivers defining a group two data drivers arranged from a first data driver to an Nth data driver;

driving a first group one data driver with the first signal;

driving the first driving region of the individual data driver with the second signal;

driving a second group one data driver with a group one carry signal after the first group one data driver completes processing the first signal;

driving a first group two data driver with a group two carry signal after the first driving region of the individual data driver completes processing the second signal;

driving sequentially each remaining group one data drivers with a carry signal generated by an immediately preceding group one data driver when the immediately preceding group one data driver completes processing its carry signal, the Nth group one data driver generating a carry signal that drives the second driving region of the individual data driver;

driving sequentially each remaining group two data drivers with a carry signal generated by an immediately preceding group two data driver when the immediately preceding group two data driver completes processing its carry signal, wherein the second driving region of the individual data driver and the Nth group two data driver complete processing their carry signals at substantially the same time.

* * * * *

UNITED STATES PATENT AND TRADEMARK OFFICE

CERTIFICATE OF CORRECTION

PATENT NO. : 7,522,144 B2
APPLICATION NO. : 11/166307
DATED : April 21, 2009
INVENTOR(S) : Kang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 875 days.

Signed and Sealed this
Seventeenth Day of May, 2011

David J. Kappos

David J. Kappos
*Director of the United States Patent and Trademark Office*